US005233143A

United States Patent [19]

Hutcherson et al.

[11] Patent Number: 5,233,143

[45] Date of Patent: Aug. 3, 1993

[54] HIGH-POWER GAS SWITCH WITH HYDRIDE ELECTRODES

[75] Inventors: R. Kenneth Hutcherson, College Park, Md.; Stuart L. Moran, Fredericksburg, Va.

[73] Assignee: The United States of America as represented by the Secretary of the Navy, Washington, D.C.

[21] Appl. No.: 788,660

[22] Filed: Nov. 6, 1991

[51] Int. Cl.[5] ..... H01H 1/02; H01H 33/00; H01J 17/02

[52] U.S. Cl. ..... 200/144 R; 200/148 R; 200/266; 200/267; 313/633

[58] Field of Search ..... 200/144 B, 148 R, 266, 200/267; 313/567, 633

[56] References Cited

U.S. PATENT DOCUMENTS

| | | | |
|---|---|---|---|
| 3,093,766 | 6/1963 | Cobine | 313/174 |
| 3,303,376 | 2/1967 | Lafferty | 313/148 |
| 3,328,545 | 6/1967 | Holliday | 200/144 |
| 3,465,205 | 9/1969 | Lafferty | 315/330 |
| 3,641,298 | 2/1972 | Broverman | 200/266 |
| 3,911,239 | 10/1973 | Lafferty | 200/144 B |
| 4,401,869 | 8/1983 | Hruda | 200/144 B |
| 4,912,369 | 3/1990 | Moran et al. | 315/58 |

OTHER PUBLICATIONS

Gas-Phase Pulsed Power Switches, Martin A. Gunderson IEEE Transactions on Plasma Science, vol. 19, No. 6, Dec. 1991, pp. 1123-1131.

*Primary Examiner*—J. R. Scott

*Attorney, Agent, or Firm*—John D. Lewis; Jacob Shuler

[57] ABSTRACT

A high-power, high-repetition-rate spark gap switch having metal-hydride electrodes is provided The spark gap switch is configured with a trigger and two electrodes fabricated with metal hydrides. The hydride metals may be selected from a variety of alloys including iron, nickel, magnesium, and palladium based alloys. Use of these alloys for fabrication of the electrodes permits hydrogen to be absorbed into the electrode material at a density approximately that of liquid hydrogen. During operation of the switch, the increasing temperature causes hydrogen to be desorbed into cavity surrounding the switch. Whereas the increasing temperature lowers the breakdown voltage of the switch, the increasing pressure raises the breakdown voltage. The result is the switch operates at a constant breakdown voltage independent of temperature.

11 Claims, 2 Drawing Sheets

HIGH-POWER GAS SWITCH WITH HYDRIDE ELECTRODES

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The field of this invention is pulse power technology and relates generally to high electrical current components. The disclosed device, in particular, is a triggerable, spark gap switch capable of maintaining a high-pulse repetition rate. A modification of the device can also be used as a surge protector or circuit breaker in electrical power delivery systems or as a transmit/-receive protective switch in high-power high-rep-rate radar systems.

BACKGROUND OF THE INVENTION

A variety of devices require high peak power pulses during operation. Typical devices using pulse power technology include particle beam accelerators, high-power microwave devices, high energy lasers, nuclear effects simulators and fusion devices. The technology field is replete with switching devices capable of high power, and typical of these is the device known as the spark gap switch.

A simple spark gap switch consists of two electrodes separated by an insulating gas. Often, one electrode is hollow having a trigger pin located inside the electrode. This trigger pin is used to initiate the main spark discharge using a low-energy pulse. Such devices can handle millions of volts and hundreds of kiloamps in low repetition rate applications (less than one hertz). In the usual operation of the switch, a spark forms, heating the surrounding gas and causing the switch to "close" and conduct electricity. The voltage at which the switch closes is the breakdown voltage. This breakdown voltage is dependent on pressure and temperature of the gas in the spark gap. If a second power pulse is applied to the switch before cooling can take place, the switch will close at a much lower voltage. The requirement for consistent operation of the switch at a specific breakdown voltage limits the repetition rate of the switch. The repetition rate is limited by the period of time required to rid the gas of the excess heat. This period is called the recovery time. The recovery time limitation means that low-energy spark gaps have been able to operate at high repetition rates, but high-power switches have been typically limited to about 10 Hz.

A variety of techniques have been used to allow higher repetition rates. One approach has been to use blowers to move hot gases out of the switch region. Above 1,000 Hz, the necessary cooling requires supersonic gas flow. The large blowers needed to provide such a flow result in a switch system that is very large and inefficient.

Spark gap switches are used in a wide variety of high-power applications requiring high currents and voltages. Low repetition rate has been the major limitation in using spark gap switches in rep-rated, high-power systems. This low repetition-rate, or lack-of-recovery, occurs because upon switch closure, a hot conductive channel forms in the interelectrode gas.

This channel heats the gas and causes a reduction in the gas-particle number density. The gas cools by a variety of processes and given enough time will reach the initial particle density and hence the initial voltage holdoff strength. This recovery time is relatively short if hydrogen is used as a fill gas, but improvement is necessary for high-repetition systems.

In prior art devices, electrodes act primarily as passive electrical contacts to the gaseous switch medium. The electrodes may provide some cooling for the conductive channels formed in the gas switch but do not actively help the recovery of the inter-electrode gas. Normally, electrodes are made of some high-refractory material (stainless steel and copper-tungsten alloys for instance) to improve electrode erosion and lifetime.

Other prior art spark gap switches exhibit special triggering to improve timing or use saturated vapor or liquid between the electrodes in an effort to reduce jitter and inductance.

SUMMARY OF THE INVENTION

It is an object of the invention to provide a high-power, high-repetition-rate, spark gap switch that exhibits low resistance and can be incorporated in low impedance pulse power systems.

It is another object of the invention to provide a triggerable spark gap switch employing high-pressure hydrogen to improve repetition rates.

It is yet another object of the invention to provide a high-power spark gap switch that maintains a constant breakdown voltage over a wide temperature range.

It is still another object of the invention to provide a high-power spark gap switch having a variable pressure.

It is a further object of the invention to provide a high-power spark gap switch having metal hydride electrodes.

The invention is a high-power, high-repetition-rate, spark gap switch having a high-pressure, high-purity hydrogen operating gas in combination with a triggerable, metal-hydride electrode. The unique feature is the use of the hydride material to form the electrode. This material has the ability to absorb large quantities of hydrogen gas. Storage densities exceeding that of liquid hydrogen can be achieved. During operation of the switch, the heat produced at the electrode causes hydrogen to be released into the spark gap thereby raising the pressure. The hydride material and quantity in the electrode is chosen to provide an increase in pressure which offsets the effect of the temperature increase, thereby maintaining a constant breakdown voltage level.

It is a further object of the invention to provide a repetitive high-power switch, circuit breaker, or surge protector, capable of improved opening times.

These and other objects, features and advantages of the invention will be evident from the following detailed description when read in conjunction with the accompanying drawings which illustrate various embodiments of the invention.

DETAILED DESCRIPTION OF THE INVENTION

Figure 1:
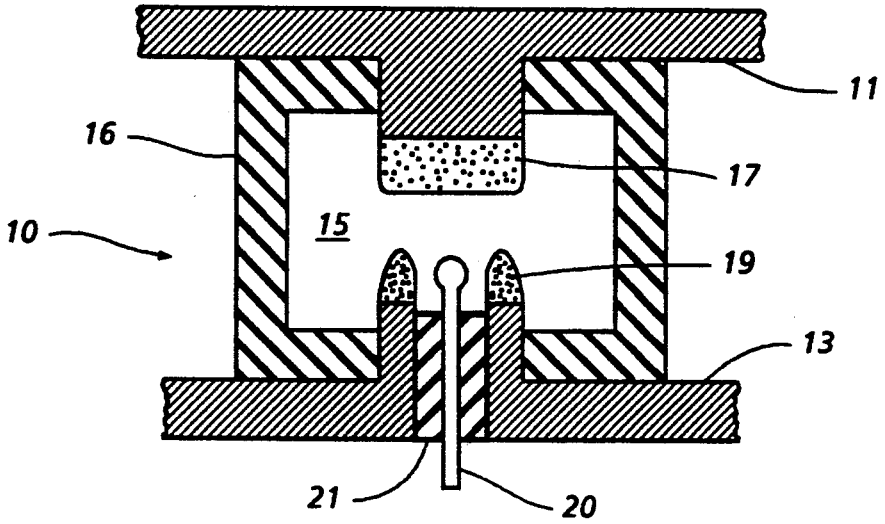
FIG. 1 is a front sectional view of a simplified embodiment of the High-Power Gas Switch.

Referring now to FIG. 1, the high-power gas switch designated generally by the reference numeral 10 is shown in cross-section. An insulating housing 16, essentially shaped as a hollow cylinder is provided forming a cylindrically-shaped cavity 15. Housing 16 has upper and lower openings to allow entry of metal electrodes. The high-voltage electrode 17 has a substantially flat surface 11 which mates with and connects to a load such as a directed energy weapon. A lower electrode 19 is essentially a tube of conducting metal, in the embodiment of FIG. 1, approximately the same diameter as electrode 17 extending into cavity 15 through the lower aperture of insulating housing 16. Lower electrode 19 is machined and operatively spaced within housing 16 so as to form a spark gap between the ringlike top surface of the hollow cylindrical portion of lower electrode 19 and upper electrode 17 at the approximate center of cavity 15.

An entry hole is machined through the center of the lower electrode 19 which provides entry into cavity 15. A trigger pin 20 extends through this hole and resides in the approximate center of the lower electrode 19. The pin is operatively spaced to reside within the center of the cylindrical portion of electrode 19 and extends into cavity 15 in cooperation with the ringlike top surface of the lower electrode. A high-pressure insulating seal 21 holds trigger pin 20 positioned in the center of the lower electrode 19 and insulates trigger pin 20 and lower electrode 19 electrically. Seal 21 is constructed with adequate strength and integrity to contain pressured hydrogen within cavity 15. It should be understood that the hydrogen may be pressurized at high pressures in the 1000 p.s.i. range, or may be below atmospheric pressure down to a near vacuum, or anywhere in between. In the low-pressure embodiments, the spark generates gas carriers which will improve turn-on speed and efficiency by using the hydride materials to desorb hydrogen gas into the low pressure region. It is important to note that all embodiments provide a switch with repeatability up to very high repetition rates. Electrodes 17 and 19 must seal with housing 16 to contain the high-pressure or low-pressure hydrogen within cavity 15. The lower end of the electrode 17 and the ringlike top surface of electrode 19 are fabricated from a rechargeable metal hydride. The material is selected to provide absorption and desorption of hydrogen gas at a particular temperature and pressure thereby providing a particular and constant breakdown voltage at the switch. Recent metallurgical advances have provided a number of metals, alloys and inter-metallic compounds which can react reversibly with hydrogen to form hydrides. The volume density of these hydrides is very large on the order of one gram of hydrogen per cubic centimeter. Certain hydrides can store more hydrogen than can be stored in the same volume of liquid. A variety of alloys based on iron, nickel, magnesium and palladium are all commercially available and suitable for fabrication of the electrodes in the present invention.

Another embodiment of the switch may be constructed with the cylindrically-shaped cavity 15 coated with a hydride material which would interact with the hydrogen. In this embodiment, the electrodes 17 and 19 may or may not be also coated with the hydride material. This embodiment might find utility in fabrication as the hydride material can be more easily coated on the inner surface of cavity 15 than on the electrodes.

In operation, the hydride-tipped electrodes go through a sequence of steps. Beginning the sequence, the top electrode 17 is charged to high voltage and the bottom electrode 19 is grounded. At the desired time, a low energy trigger pulse of short duration is applied to the trigger pin 20. The trigger pulse is typically charged to the opposite polarity of electrode 17. When the trigger pulse is applied, a low-energy spark forms between the trigger pin 20 and the lower electrode 19. This low-energy spark is the trigger which initiates the main spark. The main spark allows the energy stored in a pulse forming line (not shown) to be discharged through the switch to a load. The heating of the electrodes as a result of the main spark causes hydrogen to be desorbed. When the main spark stops, the electrodes begin to cool and hydrogen is re-absorbed. The sequence is repeated in each repetitive operation of the switch. In the preferred embodiment, cavity 15 is charged with pure hydrogen gas to around 1000 psi to increase the self-breakdown voltage of the switch. However, hydride materials can operate reversibly at much lower pressures and the present invention may also be applied to low-pressure diffuse discharges and vacuum spark gaps.

Figure 2:
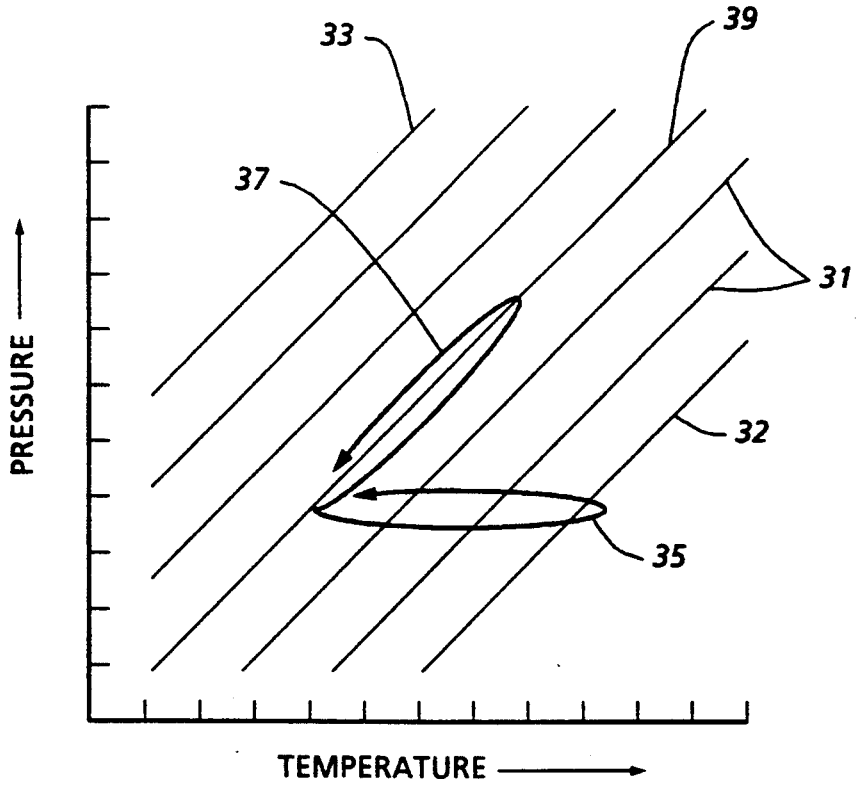
FIG. 2 is a graph showing lines of a constant breakdown voltage at various pressures and temperatures.

Referring now to FIG. 2, the pressure and temperature relationships of the gas during operation of the switch with the effects of the hydride-electrode material is shown. The operating pressure and temperature of a gas switch directly effect the breakdown voltage of the switch. Since breakdown voltage is largely a function of gas particle density, breakdown voltage drops as temperature increases (for a given pressure), and as pressure decreases (for a given temperature). FIG. 2 depicts a series of constant break-down voltage lines 31 running parallel to one another diagonally across the pressure-temperature chart. Constant voltage line 33 is representative of a high constant breakdown voltage where both temperature and pressure are adjusted to achieve the particular breakdown voltage. Similarly, constant breakdown voltage line 32 represents a low breakdown voltage.

For purposes of illustration, the pressure-temperature relationship of a typical conventional spark gap switch is represented by loop 35. Firing of the switch occurs at the dot on constant voltage line 39. Thereafter the temperature rises during operation of the switch while the pressure remains relatively constant. As a result, the breakdown voltage of the switch decreases to values represented by lines 31 and ultimately line 32. After current stops flowing in the switch, the gas begins to cool. The portion of loop 35 returning from line 32 to the dot on line 39 represents the recovery time of the switch as the gas temperature drops. Operation of the conventional switch prior to the elapse of the recovery time will result in poor operation, that is, operation at an undesirable lower breakdown voltage.

In contrast, operation of the switch of this invention is represented by loop 37. The switch again fires at the dot on line 35. Again the temperature increases as the switch operates, thereby moving to the right on the graph. However, hydrogen is desorbed from the electrodes at the same time, thereby raising the pressure in cavity 15 causing an upward moving of parameters on the graph of FIG. 2. The effect is that as temperature increases lowering the breakdown voltage, pressure also increases and thereby increases breakdown voltage. This offsetting effect results in a constant voltage breakdown as represented by line 39. Since the switch is always at the same breakdown voltage value, that is, along line 39, it is not necessary to wait for the recovery time to elapse. The switch may be operated cold, hot, or at any intermediate temperature. The breakdown voltage remains constant. By proper selection of hydride materials and operating parameters, a switch may be made to operate along a variety of constant voltage breakdown lines.

The advantages of the present invention are numerous. The novel use of hydride material in the electrodes permits a constant break voltage operation of the spark gap at variable temperatures. As a result, the operation of the switch becomes effectively independent of temperature. Further, the use of the hydride material in the electrodes allows an immediate absorption-desorption action without lag time. The result is that repetition rate can be increased far beyond that in conventional switches.

Another advantage of Applicants' switch is an improvement in trigger capability and timing. The switch also provides a localized increase in gas pressure around the spark channel exactly where it is needed.

Although the invention described herein has been described relative to a specific embodiment, many variations will be readily apparent to those skilled in the art. For example, a hydride switch may be adapted to work as an opening switch by selecting material and operating conditions which will provide pressure increase fast enough to cause the switch to open against voltage and stop conducting. This type of switch has application in compact inductive devices.

Figure 3:
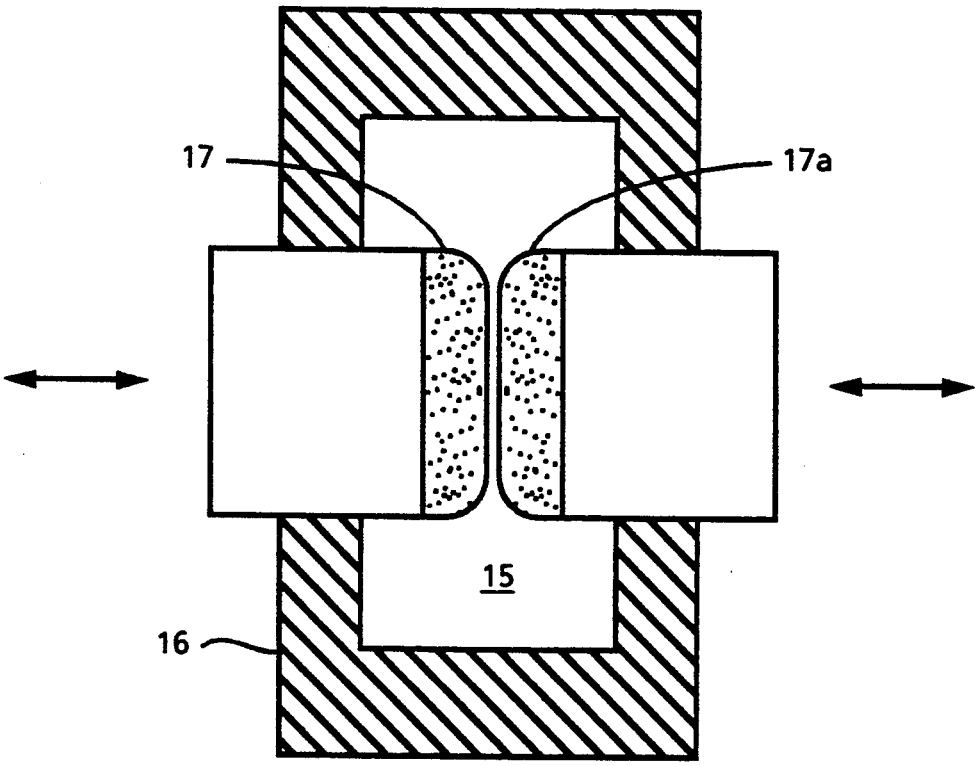
FIG. 3 is a cross-sectional view of a simplified embodiment of a circuit breaker.

A two-electrode device, using hydride materials, may be used as a circuit breaker. Referring to FIG. 3, the two electrodes 17 and 17*a* are held together and pass current as part of a power cable. When current interruption is desired, the two electrodes are moved apart mechanically, drawing an arc between them. This arc heats the hydride materials and raises the gas pressure, helping to extinguish the arc and forming a successful current interruption.

The hydride switch may also be used as a voltage surge protector. One electrode is the high-voltage part of a power cable and the other electrode is ground. If a high-voltage transient (such as a lightning strike) appears on the cable, the switch breaks down, shunting current away from sensitive components to prevent damage. The hydride materials in the switch release hydrogen and the switch pressure increases, causing the shunted current to cease and the re-application of power to the cable. The hydride switch assures an opening of the surge protector and allows faster re-application of power.

What is claimed is:

1. A high-power gas switch comprising:

a. a high-pressure chamber;

b. first and second primary electrodes having opposed electrode surfaces and defining a primary arc gap within said chamber, each of said opposed electrode surfaces being completely covered with a hydride metal;

c. a high-pressure hydrogen gas in said chamber; and d. a trigger pin positioned within said first primary electrode, said trigger pin defining a trigger gap between itself and said first primary electrode and being capable of receiving a trigger pulse.

2. A high-power gas switch as in claim 1 wherein said metal hydride is an iron-based alloy.

3. A high-power gas switch as in claim 1 wherein said metal hydride is a nickel-based alloy.

4. A high-power gas switch as in claim 1 wherein said metal hydride is a magnesium-based alloy.

5. A high-power gas switch as in claim 1 wherein said metal hydride is a palladium-based alloy.

6. A high power gas switch as in claim 1 wherein said high-pressure chamber is coated with a metal hydride on the inner surface thereof.

7. A high-power gas switch as in claim 6 wherein said metal hydride coated on the inner surface of said chamber is an iron-based alloy.

8. A high-power gas switch as in claim 6 wherein said metal hydride coated on the inner surface of said chamber is a nickel-based alloy.

9. A high-power gas switch as in claim 6 wherein said metal hydride coated on the inner surface of said chamber is a magnesium-based alloy.

10. A high-power gas switch as in claim 6 wherein said metal hydride coated on the inner surface of said chamber is a palladium-based alloy.

11. A high-power gas switch as in claim 1 wherein said first and second primary electrodes are fixed in relation to one another to define a fixed primary arc gap.

* * * * *